United States Patent [19]

Netz et al.

[11] Patent Number: 4,598,040

[45] Date of Patent: Jul. 1, 1986

[54] PHOTOGRAPHIC SYSTEM AND PROCESS

[76] Inventors: Yoel Netz, 5 Massada Street, Bat-Yam; Arnold Hoffman, 5 Hagra Street, Rehovot, both of Israel

[21] Appl. No.: 531,611

[22] Filed: Sep. 12, 1983

Related U.S. Application Data

[63] Continuation-in-part of Ser. No. 318,921, Nov. 6, 1981, abandoned.

[30] Foreign Application Priority Data

Nov. 16, 1980 [IL] Israel ..... 61497

[51] Int. Cl.[4] ..... G03C 5/24; G03C 1/02

[52] U.S. Cl. ..... 430/405; 430/265; 430/268; 430/420; 430/423; 430/434; 430/448; 430/465; 430/485; 430/486; 430/490; 430/566

[58] Field of Search ..... 430/268, 404, 405, 490, 430/246, 423, 425, 434, 448, 464, 465, 264, 265

[56] References Cited

U.S. PATENT DOCUMENTS

| | | | |
|---|---|---|---|
| 707,403 | 8/1902 | Eichengrün | 430/490 |
| 3,255,008 | 6/1966 | Tefft | 430/488 |
| 3,705,806 | 12/1972 | Sykes et al. | 430/490 |
| 3,713,826 | 1/1973 | Sykes et al. | 430/490 |
| 3,776,731 | 12/1973 | Iwano et al. | 430/490 |
| 3,785,822 | 1/1974 | Overman | 430/268 |
| 3,793,027 | 2/1974 | Okutsu et al. | 430/268 |
| 3,799,780 | 3/1974 | Suga | 430/268 |
| 3,870,479 | 3/1975 | Kubotera et al. | 430/490 |
| 3,947,273 | 3/1976 | Pollet et al. | 430/268 |
| 4,180,402 | 12/1979 | Andreev et al. | 430/394 |
| 4,269,929 | 5/1981 | Nothnagle | 430/490 |
| 4,272,614 | 6/1981 | Mifune et al. | 430/267 |

FOREIGN PATENT DOCUMENTS

| | | | |
|---|---|---|---|
| 104631 | 10/1974 | Japan | 430/268 |
| 1343718 | 1/1974 | United Kingdom | 430/268 |

OTHER PUBLICATIONS

Chem. Abst. 162994x, vol. 82, 1975.

*Primary Examiner*—Mary F. Downey

*Attorney, Agent, or Firm*—Toren, McGeady, Stanger, Goldberg & Kiel

[57] ABSTRACT

There is provided a developer for use in a one-step process for the development of exposed film resulting in an exposurewise pattern of silver particles which are large enough to be used as printing elements in ink-printing techniques, providing a wide range of densities in the developed film. The developer is based on a buffered system of a developing agent, a sulfinic acid salt of the type $HO\text{-}R\text{-}SO_2.M.\times H_2O$ where R is a hydrocarbyl group and M is a cation, and a formaldehyde source, with conventional adjuvants such as anti-fogging agents and the like. Instead of the sulfinic acid salt defined above there may be used any compound which upon dissociation in a aqueous medium results in the same active ionic species.

15 Claims, 2 Drawing Figures

PHOTOGRAPHIC SYSTEM AND PROCESS

STATUS OF APPLICATION

This is a continuation in part application of U.S. patent application Ser. No. 318,921 filed Nov. 6, 1981, now abandoned.

BACKGROUND OF THE INVENTION

In Israel Pat. No. 35721 a novel photographic process is described which results in a half-tone screenless image. This image has a much higher resolution than the conventional screen process, whose image is made up of ordered geometric dots, formed by exposing through a screen. The absence of a screen permits the use of simpler and less expensive photographic equipment and also, in multi-color printing, avoids the problem of Moirer Effect.

The above described screenless processing technique, referred to as "grain technique", is a complex, three-stage process, involving two subsequent exposure steps and three independent processing steps. The complexity of the process results in a certain unreliability and in an expensive process.

In order to provide a screenless process resulting in a product which can be used in ink printing processes, a process which is practical, a simple one-step process of development after the initial exposure, is required.

There exists the general problem of deterioration of the developing agent when in solution, and this shortens the active lifetime of such solutions. The present invention provides means for overcoming this problem by novel means.

SUMMARY OF THE INVENTION

There is provided a one-step process for the development of exposed film, resulting in an exposurewise pattern of silver particles of adequate size to serve as printing elements in screenless ink-printing techniques, providing a wide range of densities in the resulting developed film. The density range, when measured on such film when same is exposed through an 0.15 density unit increment step-wedge and developed by the development process of the invention, results in the ability to distinguish up to 18 of the 21 steps of the wedge. The superior screenless image thus obtained is termed by us hereinafter as "grain image". The process is based on the use of a novel developer comprising a developing agent, a salt of sulfinic acid hereinafter defined, formaldehyde or a source of formaldehyde, and a buffer adapted to maintain a predetermined range of pH during the entire development process. The developer advantageously comprises also an antifogging agent and optionally also conventional additive such as a stabilizer, a metal scavenger, a viscosity control agent, and an agent for controlling the grain size of the film. It is clear that a combination of such additives can be used. The novel developer brings about the start of development of less exposed grains before the complete development of the most exposed grains. This is due to the phenomena:

1. whereas the induction period of heavily exposed grains, $\tau$, for both the conventional lith and grain technique are comparable, the rate of the continuation stage is much slower in the grain technique than in the conventional lith technique. $\tau$ is the period of induction, i.e. the period of time between start of contact with developer and when the silver image becomes apparent.

2. whereas the plot of induction period vs. exposure is relatively steep at higher exposure levels for the conventional process, the plot is relatively flat in the grain technique across a broad exposure range.

The result is that in the conventional lith technique the heavily exposed grains are fully developed, and the less exposed grains remain completely undeveloped. In the grain technique, all grains (above a given exposure level, of course) are developed to an extent which is a function of their exposure. In the highly exposed areas, the completely developed grains, (by a mechanism of infectious development and perhaps by clumping) produce a large number of silver particles per unit area. In the less exposed regions, having a larger induction period, $\tau$, the mechanism of infectious development (and perhaps clumping), triggered by development, produce smaller size silver particles per unit area because of the relatively short period of time left for the continuation stage, T-$\tau$, where T is the residence time of the film in the developer.

The above theory is a useful frame of reference, but is in no way meant to limit the invention. The developer solution for use in the process of the invention comprises a number of imperative constituents:

a. a developing agent;
b. a pH buffer adapted to maintain the pH in a predetermined range during the entire development process;
c. a salt of an organic sulfinic acid compound, as defined;
d. formaldehyde or a source thereof, such as a compound or composition gradually releasing formaldehyde.
e. an antifogging agent.

DESCRIPTION OF THE PREFERRED EMBODIMENT

Figure 1:
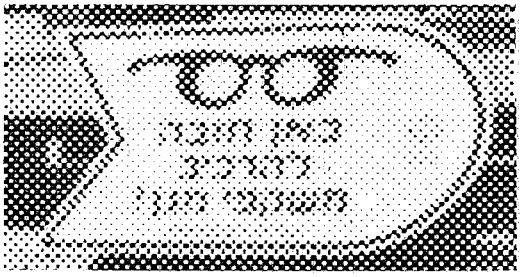
FIG. 1 is a print obtained using conventional techniques.

The salt of the sulfinic acid can be presented by the formula $$HO\text{-}R\text{-}SO_2.M.\times H_2O$$

wherein R is a hydrocarbyl group and M is a metal cation or metal cation equivalent. Preferred metal ions are alkali metal ions, such as sodium or potassium. There may also be used alkaline earth cations, with suitable adjustment for the valency. The simplest hydrocarbyl groups of the compounds are groups of the alkane type, i.e. $—CH_2—$; $—CH_2\text{-}CH_2—$ etc. There may also be present alkene groups such as $HO\text{-}CH{=}CH{=}SO_2.M\times H_2O$; etc. The nature of the hydrocarbonyl group is generally not critical. A preferred compound of this type has been extensively tried out and gave excellent results. This is the compound known as sodium formaldehydesulfoxylate, as hydroxymethylene sulfinic acid sodium salt; as formaldehyde sodium sulfoxylate, as sodium methanesulfoxylate, see Merck Index, 9th Edition, #8369 (1976), where the gross formula is given as $CH_3NaO_3S$. This compound, presented by the above formula as $HO\text{-}CH_2\text{-}SO_2Na.2\ H_2O$, is also known as Rongalite. The gross formula would seem to indicate that this is a sulfite type compound, but the correct definition seems to be a salt of an organic sulfinic acid. The actual salt thought to be operative is a 1:1 adduct of formaldehyde and the sulfinic acid (methylol sulfinic acid salt). A preferred developing agent is hydroquinone, and when this is used the pH ought to be maintained during the course of the development process within the range of pH 9.6 to pH 10, and preferably pH 9.6 to pH 9.8. A typical concentration of the developing agent is from about 1 g/liter to about 25 g/liter; the preferred range being about 3 to 6 gram/liter. When hydroquinone is used, there is advantageously used a buffer system of the sodium carbonate/sodium bicarbonate type which maintains the pH in the vicinity of pH 9.8.

A certain quantity of formaldehyde is required in the developer solution. This is generally in the range of from about 0.08M to 0.6M. The sulfinic acid salt (also termed "sulfoxylate") is used in a range of concentrations of 0.08M to about 0.6M. The preferred concentration of both formaldehyde and the sulfinic acid salt is about 0.08 to 0.4M.

As stated above, formaldehyde must be present in the developer according to the invention. There may be used any suitable source thereof: formaldehyde itself, paraformaldehyde or any agent or composition adapted to release the required quantity of formaldehyde during the development process. The formaldehyde may also by physically bound to a suitable carrier or matrix.

Experiments carried out with a developer as defined above, at a pH of 10.5, resulted in a grain size about one-third to one half of that required for the direct ink-printing process. If blown up by a factor of 2 to 3, this can be used for a useful half tone.

Combinations of hydroquinone with other developing agents can be used.

Suitable antifogging agents are alkali metal halides such as sodium or potassium chlorides, bromides, iodides, or mixtures of any of these benzimidazoles or benzotriazoles. These are advantageously used in concentrations as low as $10^{-4}$ or as high as 0.1M. Further optional constituents of the developing system are as follows:

(a) a stabilizer, such as boric acid for prolonging duration of activity of the developer;

(b) a metal ion scavenger, such as EDTA, to "clean up" processing solutions;

(c) a viscosity control agent, such as glycerol CMC, polyacrylic acid;

These additives, although useful, are not critical, as the essential novelty of these new developer formulations is thought to be the choice of a suitable formaldehyde and pH buffer which permits the infectious development—clumping process—to occur as a function of exposure over a broad exposure range. The standard additives, commonly employed in the graphic arts, e.g. sodium formaldehyde bisulfite and non-buffered bases, produces a relatively sharp increase in $\tau$, with exposure in the lower exposure regions and a rapid continuation stage. By replacing it with a suitable formaldehyde and pH buffer, such that $\tau$ is less sensitive to exposure even in the low exposure regions, and the continuation stage is slowed down, the desired grain effect is produced and there is obtained a size distribution of silver particles which is a function of exposure.

According to an embodiment of the invention, which is also applicable to other developer systems, the developing agent is separated from the other constituents of the developer solution, and contacted with the other ingredients and with the photographic medium which is to be developed.

According to one embodiment of this aspect of the invention, the developing agent is disposed on, or distributed through part or the entire volume of a suitable substrate or carrier, and this in solid form, and before development this carrier or substrate is wetted with the solution containing the other ingredients of the developer solution, and subsequently contacted with the medium to be developed.

A carrier or substrate may be impregnated with the solid developing agent or same may be applied to the surface thereof as a thin layer, the quantity being according to the effect required with the developed photographic medium (plates, films, paper), and the solution of the other ingredients may be provided in suitable sealed small containers, such as pouches or the like, which are mechanically opened and their content released and used to wet the said carrier or substrate prior to development. The solid developer may be provided in any suitable matrix, and it may be applied to an adhesive layer. The development agent in a solid form or as an oil dispersion can also be added to the emulsion before coating.

The solution of the other ingredients can be provided in a separate container that is opened mechanically, and whose contents are spread between the above mentioned substrate and the film to be processed. This can be accomplished, as is well known in the photographic arts, by the use of a pod-spreader or roller systems or to disperse the solution by means of a brush. This prevents the deteriorating of the developer system upon storage, that normally results from the developing agent being combined with the solution for long times before use.

EXAMPLE 1

A developer solution was prepared, which contained:

Hydroquinone: 6.8 g.

Hydroxymethane sulfinic acid sodium salt (Rongalite): 13.5 g.

Sodium carbonate: 48 g.

Sodium bicarbonate: 15 g.

Sodium chloride: 3.2 g.

Paraformaldehyde: 3.0 g.

Water was added to a total volume of 1 liter.

A Fuji Lith Ortho Film Type L was exposed through a 21-step variable density wedge with 0.15 density unit increments. As comparison, the same film was exposed in the same manner. The first film was developed with the above developer according to the invention, and the second film was developed in a standard lith developer (Kodalith of Kodak Inc.). Both were developed during 90 seconds at 20° C., fixed washed and dried.

The control resulted in the conventional high contrast continuous tone image, which was not suitable for ink printing masters. The film developed in the developer according to the invention showed clearly 16 distinguishable steps, each made up of a dispersion of black silver particles, large enough to serve as printing elements in ink printing techniques.

EXAMPLE 2

Figure 2:
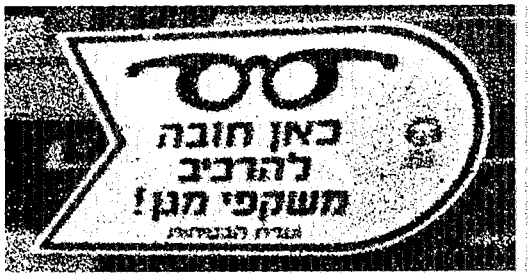
FIG. 2 is a print obtained with the developer and process of the present invention.

A 35 mm negative was exposed on the same film as Example 1, and developed in the developer of the invention, and the resulting positive half tone was used to prepare a printing master and the resulting positive together with a blow-up of part of the picture (on top) are attached herewith as FIG. 1 and FIG. 2.

FIG. 1 and FIG. 2 are prints obtained under the same conditions of ink printing from half-tones prepared in FIG. 1 with the conventional screen technique and FIG. 2 by the process of the invention. Exposures were made on Agfa 0–71 film through a screen for FIG. 1, and developed in normal Lith developer. Exposure was made on the same film for FIG. 2 without any screen and developed according to the invention (Example 1). Blowups were prepared from the same corresponding section of the negatives, contacted with an offset printing plate and printed with a multilith type printing machine. The results are presented in the figures. Much better details are discernible in FIG. 2 than in FIG. 1.

EXAMPLE 3

A developer was prepared as in Example 1, but without hydroquinone. To an inert pad plastic substrate there was applied a thin layer of hydroquinone is solid form (about 1 g/200 $cm^2$) and before development the solution was applied to this pad, an exposed Kodak 255 line film was contacted with the pad and left in contact for 60 seconds, and processed as in Example 1.

There was obtained a screenless grain effect half-tone image.

EXAMPLE 4

There was prepared a developer according to Example 1, but the developing agent was replaced by the same quantity of hydroquinone diacetate+quinone. One solution contained all the ingredients except hydroquinone and the pH of this solution was increased by means of adding more carbonate. The second solution contained per liter hydroquinone diacetate 30 g, 100 gr. sulfoxylate, 2 gr. quinone, and the solvent was a water-acetone mixture of 60 ml acetone per liter water. The two solutions were mixed before use, thus activating the developing agent (conversion to the hydroquinone). An exposed Agfa Gevaert (0711P) line film was processed as in Example 1 and similar result obtained.

EXAMPLE 5

A developing solution of the type used in Example 1 was rendered viscous by the addition of about 2 to 5 weight-% of sodium carbonate cellulose. The resulting viscous product was applied in the form of a thin layer to an exposed Fuji line film which was developed giving similar results.

EXAMPLE 6

An inert substance was coated with a thin layer of solid hydroquinone. The developing solution of the type used in Example 1, but without hydroquinone, was contained in a number of small hermetically sealed containers periodically spaced consistent with the format of the Agfa Line film to be developed and these were mechanically opened, releasing the liquid prior to development, forming an even layer, which served as developer, giving similar results.

EXAMPLE 7

A developing solution as in Example 5 was filled in a hermetically closed tube-type container and applied in appropriate amounts by coating it on an exposed sheet of film, while the unused stock part of it remained protected against oxygen and therefore kept for a prolonged period its initial properties. Each coating produced good reproducible results.

EXAMPLE 8

A developer was prepared, as in Example 1, but without hydroquinone. Hydroquinone in solid form was dissolved in this for 5 minutes prior to use. An exposed Kodak line film was developed. The result was a good grain effect half tone.

EXAMPLE 9

A developer as in Example 5 was prepared but without hydroquinone. Hydroquinone was dissolved in water and thickness by addition of CMC to achieve similar viscosity as in the above mentioned solution. The two viscous solutions were kept in normal corked containers and appropriate amounts of them were mixed prior to developing action and coating the mixture as a layer on an exposed film. A good grain effect result was obtained.

EXAMPLE 10

The developer of Example 1 was used to develop an x-ray film, Agfa RP-1. This developer solution produced a grain, edge enhancement effect.

EXAMPLE 11

Solid hydroquinone powder (from 0.1 g to 5 g/liter emulsion) can be mixed into a liquid photographic emulsion (line or lith type) prior to coating it on the film base; or hydroquinone dispersed in gelatin (0.1 g/200 $cm^2$) can be applied as a thin film to the film surface. A developing tank of an existing processing machine, such as "Versomat" can be filled with a solution of Example 1, but without the hydroquinone. The above mentioned emulsion was then processed in the above processor, containing the solution made up according to example 1, but without hydroquinone. A good grain effect result was obtained.

Coating a second "trapping" layer of gelatin of some microns, thickness onto the above allows the solution to be used more frequently before requiring replenishment or renewal. (This layer apparently traps the products of development). Similar results are obtained by substituting 1–5% polyacrylic acid layers for the gelatin. In the latter case, the layer(s) are more easily removed in the subsequent washing step. The "trapping" layer can be passive in that its thickness can minimize diffusion of products of development out, or it could be active in that it contains entities that can chemically react with products of development.

EXAMPLE 12

The developer of Example 1 was used to develop a Kodak Line Film exposed by reflection to an original containing both text and a continuous tone image. The development time was prolonged from the normal 120 sec. at room temperature to 140 seconds, so that the highlights of the original will appear black. The result was a high quality half-tone image with a good quality black-on-white text. (The conventional process requires a dual process which involves a separate sheet of film for text, a separate sheet of film for the continuous tone image, and then "stripping" the two together.

EXAMPLE 13

A continuous tone panchromatic film Tri-X, (produced by Kodak) was exposed in a camera and developed as in Example 1. A "grain effect" halftone was produced. This halftone is suitable for composing a layout for a printing master, as for example, for newspapers.

EXAMPLE 14

Four sheets of Tri-X film were color-separated by exposing through the appropiate color filters from a color transparency. Each of the exposed films was then developed as in Example 1. A Chromal in test proof was made. The result is a color image, free of Moiree patterns, with well defined details, compared to the four screen conventional processes.

EXAMPLE 15

A developer formulation was prepared as in Example 1, except that the hydroquinone was replaced by 20 gr ascorbic acid/liter. The developer was used to develop an exposed Fuji Lith Film. After fixation and washing, the film was treated in Standard Farmers' Reducer (potassium ferricyanide plus Hypo) for 30 seconds and then rinsed. A screenless halftone image was obtained by enlarging 3 times.

EXAMPLE 16

A developer formulation was prepared as in Example 1, except that the hydroquinone was replaced by 1 g/liter hydrazine sulfate, and the pH was increased to 11 by adding $K_2CO_3$. It was used to develop an exposed Fuji Lith Film. Treating as in Example 15, but increasing the time in Farmers' reducer to 60 seconds, produces a result similar to that of Example 15.

We claim:

1. A developer which comprises a development agent, a pH buffer for maintaining the pH within a predetermined range during the development process, a salt of an organic sulfinic acid compound of the formula $HO\text{-}R\text{-}SO_2.M\times H_2O$ wherein R is a hydrocarbyl groups, M is a metal cation or metal cation equivalent, or a compound which upon dissociation in an aqueous medium yields an active species of this type; formaldehyde or a source thereof other than the organic sulfinic acid salt, and an anti-fogging agent.

2. A developer according to claim 1 wherein the sulfinic acid salt is of the formula $HO\text{-}CH_2\text{-}SO_2Na.2H_2O$.

3. A developer according to claim 1 wherein the development agent is hydroquinone and the pH is maintained between 9.6 and 10.0 during the development process.

4. A developer according to claim 1 wherein the concentrations of the sulfinic acid salt and of the formaldehyde or formaldehyde source is between 0.08M and 0.4M.

5. In a process for developing a film wherein the film is exposed in conjunction with a continuous tone original, and the exposed film is developed with a developer, the improvement which comprises exposing the film in conjunction with a continuous tone original in the absence of a screen and wherein the developer comprises a development agent, a pH buffer for maintaining the pH within a predetermined range during the development process, a salt of an organic sulfinic acid compound of the formula $HO\text{-}R\text{-}SO_2.M\times H_2O$ wherein R is a hydrocarbyl group, M is a metal cation or metal cation equivalent, or a compound which upon dissociation in an aqueous medium yields an active species of this type; formaldehyde or a source thereof other than the organic sulfinic acid salt, and an anti-fogging agent.

6. A process according to claim 5 wherein the film is lithographic film.

7. A process according to claim 5 wherein the film is X-ray film.

8. A process according to claim 5 wherein the film is a high speed continuous tone panchromatic film.

9. In a process for developing a photographic film wherein a film containing a photosensitive emulsion thereon is exposed in conjunction with a continuous tone original, and the exposed film is developed using an activator solution, the improvement which comprises exposing the film in conjunction with a continuous tone original in the absence of a screen, the emulsion containing a development agent distributed therein; and the activator solution comprises a pH buffer for maintaining the pH within a predetermined range during the development process, a salt of an organic sulfinic acid compound of the formula $HO\text{-}R\text{-}SO_2.M\times H_2O$ wherein R is a hydrocarbyl group, M is a metal cation or metal cation equivalent, or a compound which upon dissociation in an aqueous medium yields an active species of this type; formaldehyde or a source thereof other than the organic sulfinic acid salt, and an anti-fogging agent.

10. In a process for developing a photographic film wherein the film containing a photosensitive emulsions thereon is exposed in conjunction with a continuous tone original, and the exposed film is developed using an activator solution, the improvement which comprises exposing the film in conjunction with a continuous tone original in the absence of a screen, and wherein a developing agent is applied to a support, the activator solution is applied to a support, and then the photographic film is contacted with the support and wherein the activator solution comprises a mixture of a pH buffer for maintaining the pH within a predetermined range during the development process, a salt of an organic sulfinic acid compound of the formula $HO\text{-}R\text{-}SO_2.M\times H_2O$ wherein R is a hydrocarbyl group, M is a metal cation or metal cation equivalent, or a compound which upon dissociation in an aqueous medium yields an active species of this type; formaldehyde or a source thereof other than the organic sulfinic acid salt; and an anti-fogging agent.

11. A process according to claim 10 wherein the developer is provided in a sealed pouch in unit dosage form, and is applied to the photographic film from said pouch when the photographic material is to be developed.

12. In a process for developing a photographic film wherein a film containing a photosensitive emulsion thereon is exposed in conjunction with a continuous tone original, and the exposed film is developed using an activator solution, the improvement which comprises exposing the film in conjunction with a continuous tone original in the absence of a screen, and wherein a development agent is applied to the emulsion of the photographic film, and then the activator solution is applied to the emulsion, and wherein the activator solution comprises a pH buffer for maintaining the pH within a predetermined range during the development process, a salt of an organic sulfinic compound of the formula $HO\text{-}R\text{-}SO_2.M\times H_2O$ wherein R is a hydrocarbyl group, M is a metal cation or metal cation equivalent, or a compound which upon dissociation in an aqueous medium yields an active species of this type;

formaldehyde or a source thereof, other than the organic sulfinic acid salt, and an anti-fogging agent.

13. In a process for developing a photographic film wherein a film containing a photosensitive emulsion thereon is exposed in conjunction with a continuous tone original, and the exposed film is developed using an activator solution, the improvement which comprises exposing the film in conjunction with a continuous tone original in the absence of a screen, and wherein a development agent is incorporated in the emulsion of the photographic material followed by application of in solid form to the emulsion, and then the thus treated emulsion is contacted using an activator solution comprising a pH buffer for maintaining the pH within a predetermined range during the development process, formaldehyde or a source thereof, other than the organic sulfinic acid salt, and an anti-fogging agent.

14. In a process for developing a photographic film wherein a film containing a photosensitive emulsion thereon is exposed in conjunction with a continuous tone original, and the exposed film is developed using an activator solution, the improvement which comprises exposing the film in conjunction with a continuous tone original in the absence of a screen, and wherein a development agent, "a salt of an organic sulfinic acid compound of the formula $HO\text{-}RO\text{-}SO_2$. Mx $H_2O$ wherein R is a hydrocarbyl group, M is a metal cation or metal cation equivalent, or a compound which upon dissociation in an aqueous medium yields an active species of this type, the formaldehyde and the antifogging agent are incorporated into the photosensitive emulsion and then development is effected by contacting the film with a buffer solution.

15. The process of claim 14 wherein the buffer is a solution of carbonate and bicarbonate.

* * * * *